US005839229A

United States Patent [19]

Briggs et al.

[11] Patent Number: 5,839,229

[45] Date of Patent: Nov. 24, 1998

[54] TELESCOPIC OPERATOR FOR CASEMENT WINDOWS

[75] Inventors: Jeffrey M. Briggs, Mountaintop; Jerome R. Galati, Pottsville, both of Pa.

[73] Assignee: Allen-Stevens Corp., West Hazleton, Pa.

[21] Appl. No.: 746,907

[22] Filed: Nov. 19, 1996

[51] Int. Cl.[6] ..... E05D 15/28

[52] U.S. Cl. ..... 149/246; 49/339

[58] Field of Search ..... 49/246, 247, 250, 49/252, 339, 340, 345; 16/65, 80; 312/334.16, 334.17, 334.36

[56] References Cited

U.S. PATENT DOCUMENTS

| | | | |
|---|---|---|---|
| 1,569,634 | 11/1926 | Sibley | 49/339 X |
| 1,573,455 | 2/1926 | Sibley | 49/339 |
| 1,744,341 | 1/1930 | Spencer et al. . | |
| 1,982,269 | 11/1934 | Schaffert et al. . | |
| 2,283,862 | 5/1942 | Peremi et al. . | |
| 2,937,765 | 5/1960 | Shank | 312/334.16 X |
| 3,032,330 | 5/1962 | Stavenau . | |
| 3,205,025 | 9/1965 | Jordax | 312/334.17 X |
| 3,838,537 | 10/1974 | Stavenau et al. . | |
| 4,241,541 | 12/1980 | Van Klompenburg et al. . | |
| 4,253,276 | 3/1981 | Peterson et al. . | |
| 4,266,371 | 5/1981 | Erdman et al. . | |
| 4,305,228 | 12/1981 | Nelson . | |
| 4,497,135 | 2/1985 | Vetter . | |
| 4,674,149 | 6/1987 | Vetter . | |
| 4,715,089 | 12/1987 | Schema . | |
| 4,726,092 | 2/1988 | Tacheny et al. . | |
| 4,823,508 | 4/1989 | Allen . | |
| 4,840,075 | 6/1989 | Tucker . | |
| 4,932,695 | 6/1990 | Pettit et al. . | |
| 5,040,331 | 8/1991 | Merendino et al. | 49/25 |
| 5,588,258 | 12/1996 | Wright et al. | 49/340 |

*Primary Examiner*—Jerry Redman
*Attorney, Agent, or Firm*—Hill & Simpson

[57] ABSTRACT

A window operator for a wide range of sizes of casement windows includes a housing in which a worm gear is mounted. An arm assembly has a gear segment that engages with the worm gear so that rotation of the worm gear causes the arm assembly and window sash to pivot outward or inward. The arm assembly includes three arms which are telescopically arranged. The inner arm and lead arm have outward facing races. The center arm has an inverted U-shape with downwardly extending legs of the U each have corresponding races. As the worm turns, the arm assembly rotates outward and the three arms slide with respect to one another.

17 Claims, 4 Drawing Sheets

FIG. 1
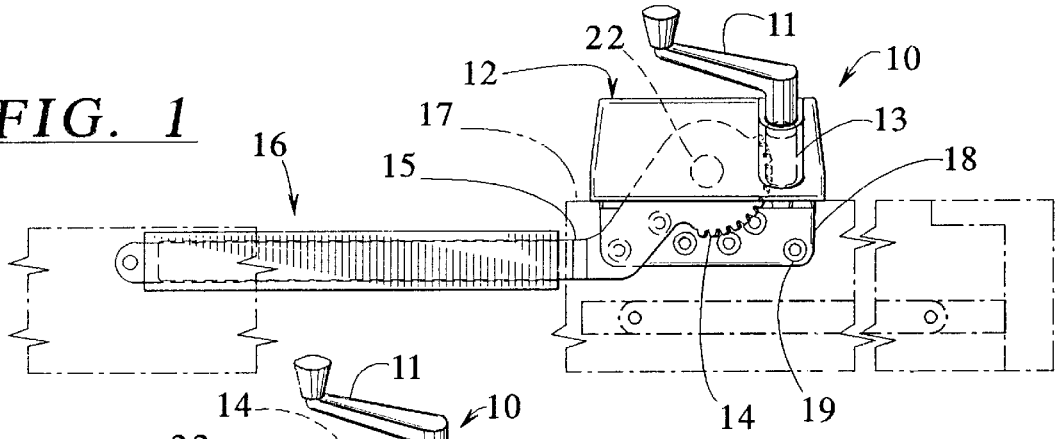
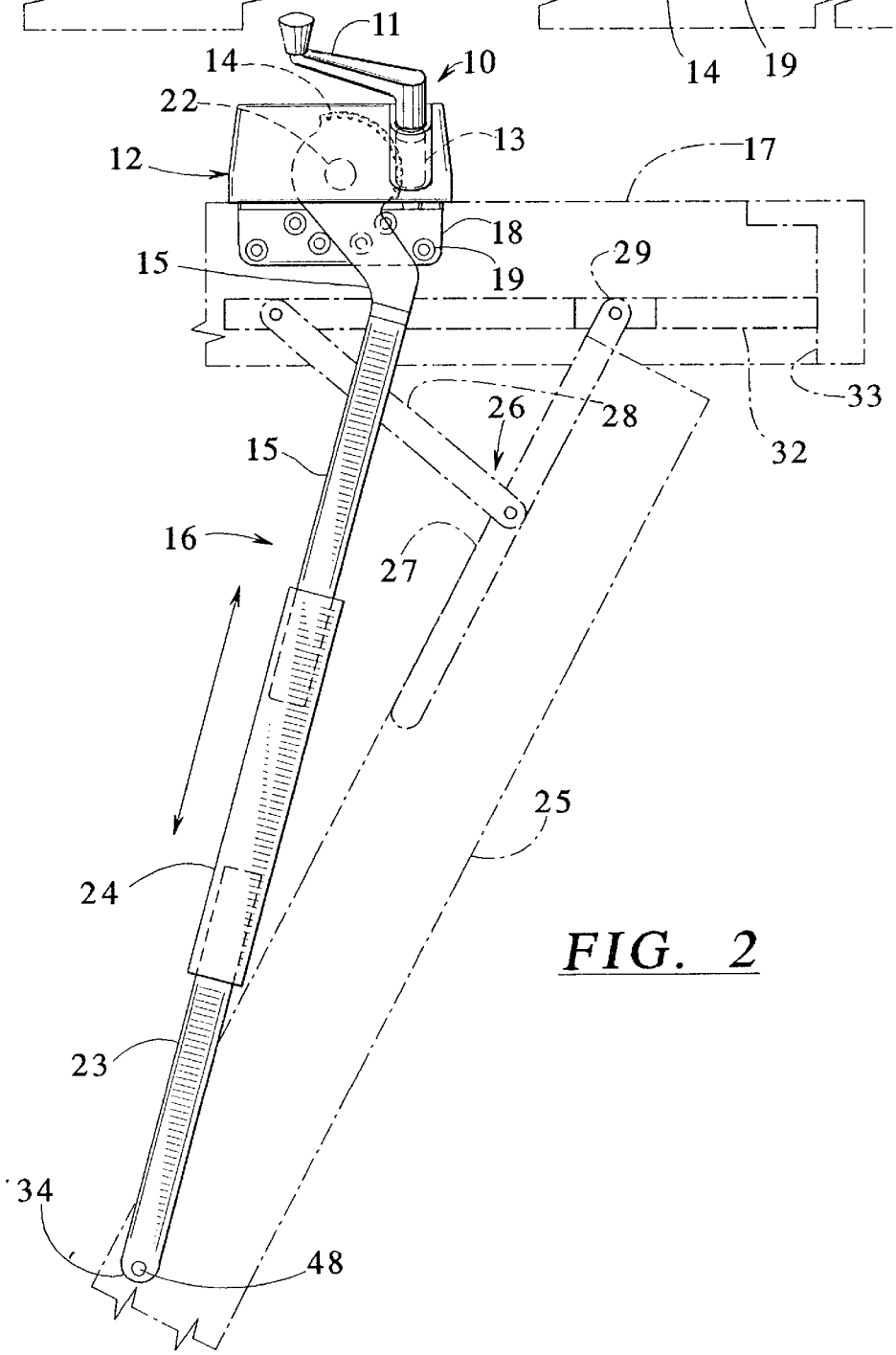
FIG. 2

TELESCOPIC OPERATOR FOR CASEMENT WINDOWS

FIELD OF THE INVENTION

The present invention relates to casement windows and, more specifically, to operators for casement windows.

BACKGROUND OF THE INVENTION

Casement window operators are known and typically include a hand crank that drives a worm gear and an arm or lever which pushes the window sash open. The worm gear is meshed with a gear segment which is part of a lever or linkage assembly that is connected to the sash. The worm gear and gear segment are accommodated within a housing. When the crank is turned, the worm gear causes the gear segment and lever to rotate which causes the sash to pivot on its hinges between open and closed positions.

A variety of different types of hinges have been used for casement windows. Virtually all casement window hinges permit the sash to both rotate and slide as it is opened. As a result, when the window is fully open, the sash is perpendicular to the window frame and one edge of the sash is positioned between the vertical edges of the window frame. So-called "egress" hinges place the sash close to one vertical edge of the frame when the window is fully open while "cleaning" hinges (such as the conventional "10 inch hinge") put the sash closer to the middle of the frame in the fully open position so that the outside surface of the glazing can be cleaned from the inside. In contrast to the egress and cleaning hinges, butt hinges permit the sash to rotate only about a fixed axis disposed along a vertical edge of the window frame. Because butt hinges require the window to pivot about a fixed axis, the operator arm which pushes the window open must be slidably attached to the window sash.

There are three general types of casement operators. One type is a single arm operator. The single arm operator has an arm which pivots about an axis that is fixed with respect to the window frame. The remote end of the arm carries a bearing which slides in a track mounted to the underside of the sash. The single arm operator is made in a wide range of sizes in order to accommodate a range of sash widths. The single arm operator is suitable for use with butt hinges because of the slidable connection between the arm and the sash, and the single arm operator can be used with egress hinges and conventional 10 inch hinges as well. One disadvantage with single arm operators is the torque required to move the sash. Specifically, because of the sliding connection between the arm and the sash, the torque required to move the sash increases as the sash moves between its closed and open positions. Near the fully open position, the amount of torque required to twist the handle or crank may be unacceptably high. Accordingly, single arm operators cannot be used with larger windows.

A second conventional casement operator is the split arm operator. This operator is similar to the single arm operator except that arm of the split arm operator has a pivot joint in the middle of the arm and the remote end of the arm is secured through a pivotable mounting to a fixed point on the sash. The split arm operator is manufactured in a variety of sizes so there is a split arm operator suitable for most sizes of residential windows. However, the split arm operator is not suitable for use with a butt hinge because of the fixed, as opposed to sliding, connection between the arm and the sash.

A third conventional type of window operator is the dual arm operator. The dual arm operator includes features common to both the single arm and split arm operators. Specifically, the dual arm operator includes one arm which rotates about a fixed axis in the housing and which carries at its far end a bearing to slide in a track mounted to the window sash, similar to the single arm operator. The dual arm operator also includes a second arm which has a pivot joint and which is secured at its remote end by a pivotable but fixed connection to the sash, similar to the split arm operator. Dual arm operators come in a variety of sizes to handle a variety of sash sizes. Different configurations of dual arm operators make it possible for them to be used with egress hinges and with conventional "10 inch" hinges. However, a dual arm operator cannot be used with butt hinges because one arm is pivotally mounted to a fixed, as opposed to sliding, point on the sash.

With both the dual arm operators and the split arm operators, there are two components whose installation and relative position is critical to satisfactory operation of the window operator. First, the operator housing must be accurately located on the window frame. Second, the bracket which forms the pivotable connection between the remote end of the arm and the sash must be accurately positioned on the sash. This is done before the arm is connected to the bracket, and therefore the two mounting operations require care and precision. The precision required to install dual arm and split arm operators is problematic because it increases the cost of manufacture. Accordingly, there is a need for a casement window operator that is as easy to install as a single arm operator but which is able to accommodate larger casement windows, unlike single arm operators, and which can be used with butt hinges, unlike the dual arm and split arm operators.

SUMMARY OF THE INVENTION

The present invention provides a casement window operator which is able to handle a wide variety of window sizes, which requires less precision installation that the split arm and dual arm operators and which can be used with butt hinges. Because a single model operator, in accordance with the present invention, can handle a wide variety of window sizes, window manufacturers' inventory can be reduced, and their assembly costs are similarly reduced because of the reduced level of required precision. Moreover, the same window operator constructed in accordance with the present invention will operate successfully with a conventional 10 inch hinge, with an egress hinge, or with a butt hinge.

Broadly, the present invention comprises a housing adapted to be mounted to a window frame. The housing carries a worm gear which is turned for example, by means of a hand crank. The worm gear meshes with an arched gear segment which is connected to an arm. The remote end of the arm is connected to the sash. When the hand crank is turned, the worm gear rotates which in turn, caused the arched gear segment to rotate, which, in turn, causes the arm to pivot about a fixed axis to open and close the sash. The remote end of the arm is connected to the sash by means of a bracket which is fixed to the sash and which provides a pivotable, but not sliding, connection between the arm and the sash.

More specifically, the present invention uses a telescopic arm assembly which includes the arched gear segment at one end to mesh with the hand-turned worm gear. The arm assembly pivots about a fixed point on the window frame when the worm gear turns. The arm assembly consists of three telescoping sections, an inner arm, a center arm, and a lead arm. The inner arm of the arm assembly projects from and may be integrally formed with the arched gear segment. The center arm slides on the inner arm and carries the lead arm.

When the sash is closed against the window frame, the three arms telescope one within the other. As the worm gear is turned to open the window, the three arms extend by sliding lengthwise one over the other until the window is fully open. This telescopic movement allows a single operator to be fitted to a wide range of window sizes and reduces the precision with which the components must be mounted to the window frame and sash.

The center arm of the telescoping arm assembly is preferably shaped like an inverted U with legs or side walls that straddle the inner and lead arms, respectively. The legs of the center arm each carry a plastic bearing insert which carry the inner and lead arms in a stacked arrangement and which permit the inner and lead arms to extend in opposite directions from within the center arm. The bearings may be made of any suitable plastic so that they permit easy sliding of the arms relative to one another, or they may be conventional roller or ball bearings.

Accordingly, an advantage of the present invention is that it provides an improved casement window operator which can be utilized with a wide range of window sizes.

Another advantage of the present invention is that it provides an improved casement window operator which is easier to manufacture and requires less precision to install.

Another advantage of the present invention is that it provides an improved casement window operator which may be utilized with butt, dual arm and split arm hinges.

Still another advantage of the present invention is that it provides a casement window operator that can be used with larger windows.

Other advantages and objects of the present invention will become apparent upon reading the following detailed description and appended claims, and upon reference to the accompanying drawings.

BRIEF DESCRIPTION OF THE DRAWINGS

FIG. 1 is a top plan view of a casement window operator made in accordance with the present invention as attached to a window frame and sash, which are shown in phantom.

FIG. 2 is another top plan view of the casement window operator shown in FIG. 1 in the extended or open position.

Figure 3:
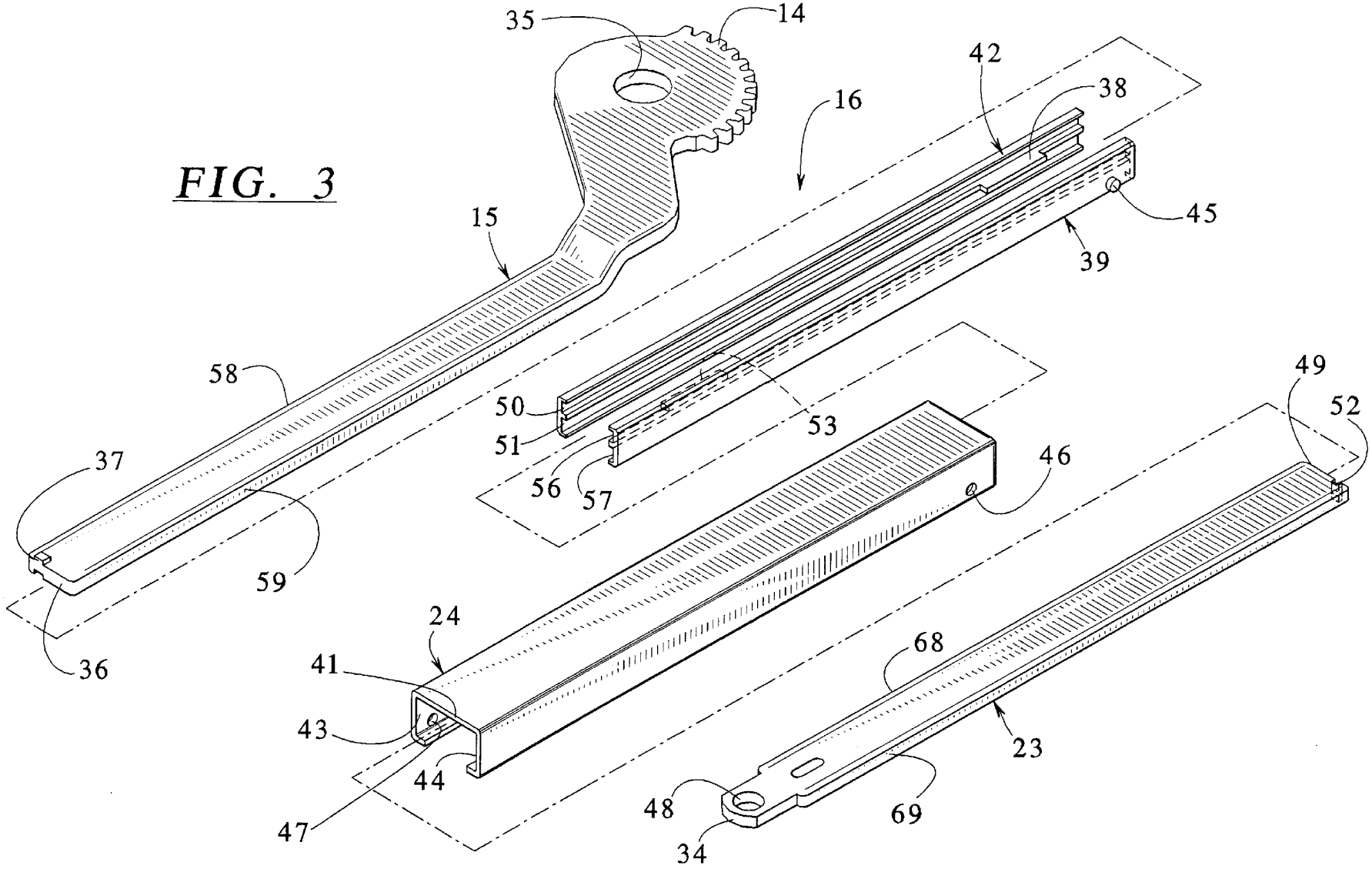
FIG. 3 is an exploded view illustrating the components of the telescopic arm of the casement window operator shown in FIG. 1.

It should be understood that the drawings are not necessarily to scale and that the embodiments are sometimes illustrated by phantom lines and fragmentary views. In certain instances, details which are not necessary for an understanding of the present invention or which render other details difficult to perceive may have been omitted. It should be understood, of course, that the invention is not necessarily limited to the particular embodiments illustrated herein.

DESCRIPTION OF PREFERRED EMBODIMENTS

Like reference numerals will be used to refer to like or similar parts from figure to figure in the following description of the preferred embodiments.

Figure 4:
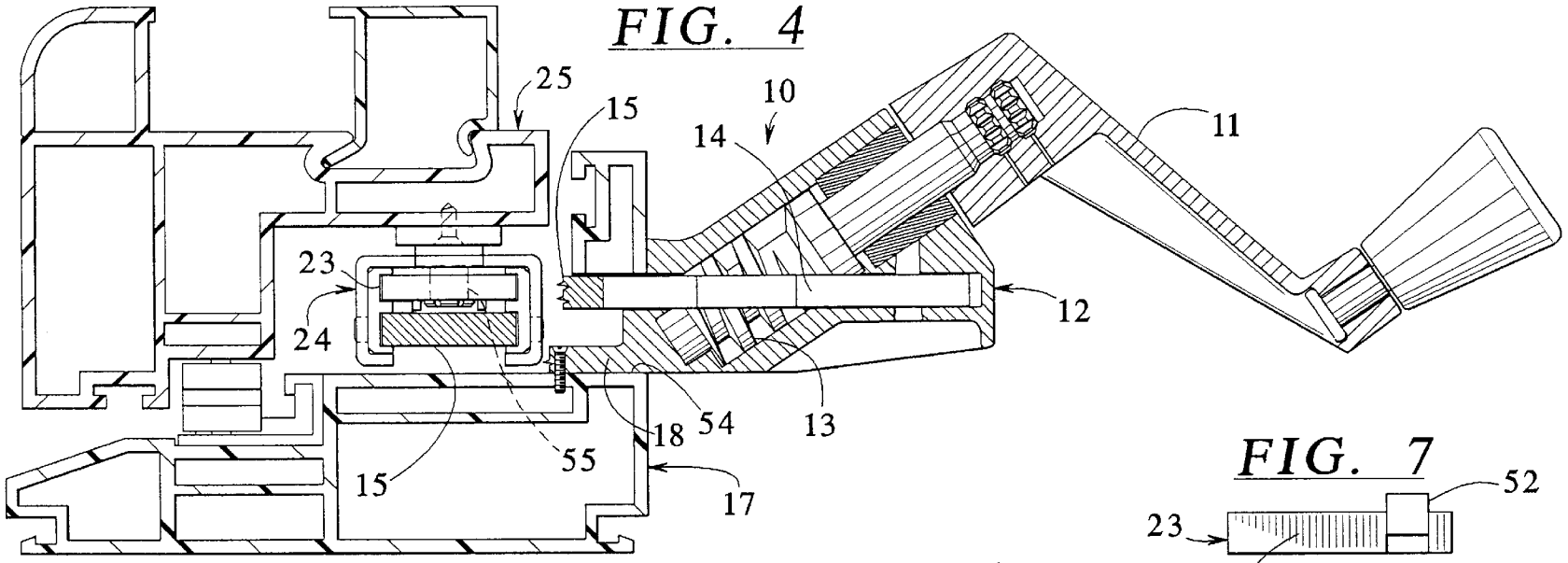
FIG. 4 is an end sectional view of the casement window operator shown in FIG. 1.
Figure 7:
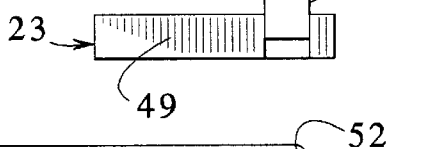
FIG. 7 is an enlarged end view of the lead arm shown in FIG. 5.
Figure 5:
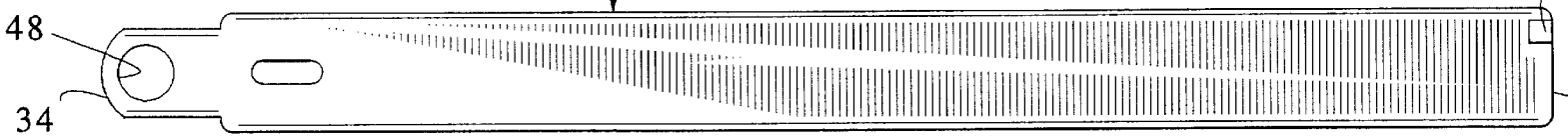
FIG. 5 is a bottom plan view of the lead arm of the telescopic arm assembly illustrated in FIG. 3.
Figure 6:
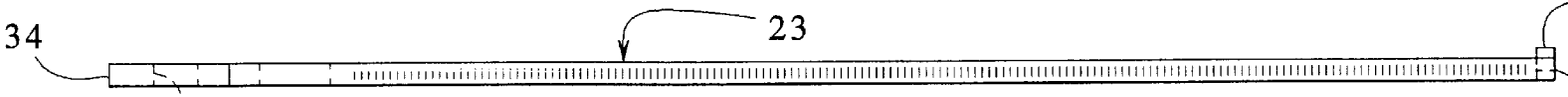
FIG. 6 is a side elevational view of the lead arm shown in FIG. 5.

As illustrated in FIG. 1, an operator 10 made in accordance with the present invention includes a hand crank 11 which is mounted to a housing 12. A worm gear 13, or other suitable gear arrangement, is accommodated within the housing and rotates upon rotation of the crank 11. The worm gear 13 is meshed with an arched gear segment 14. Rotation of the worm gear 13 results in rotation of the arched gear segment 14. The arched gear segment 14 is either connected to or an integral part of an inner arm 15 of a telescopic arm assembly shown generally at 16. The housing 12 is mounted to the window frame 17 by way of the outwardly extending plate 18 which includes a plurality of screw holes 19 through which screws or bolts are inserted to fixedly attach the housing 12 to the frame 17. The attachment of the housing 12 to the frame 17 is also illustrated in FIG. 4. The arched gear segment 14 and inner arm 15 pivot about an axis shown at 22 which may comprise an upwardly protruding shaft or stud disposed within the housing 12.

Operation of the casement window operator 10 is further illustrated in FIG. 2. The crank 11 has been rotated a sufficient number of times to cause the arched gear segment 14 and inner arm 15 to be rotated by way of the engagement of the worm gear 13 with the arched gear segment 14 to the position shown in FIG. 2. Rotation of the arched gear segment 14 and inner arm 15 about the axis defined by the shaft 22 results in the outward extension of the telescopic arm 16 and, more specifically, the sliding of the middle arm or first extending member 24 and lead arm or second extending member 23 outward to the position shown in FIG. 2. The movement of the arms 23, 24 outward can be characterized as radially outward with respect to the axis of the gear segment 14 defined by the stud or shaft 22. Further, the window sash 25 is also pivoted laterally inward away from the vertical frame member 33 due to the action of the hinge 26 which includes a first arm 27 mounted to the underside of the window sash 25 and a second arm 28 which is pivotally connected to the first arm 27 (and consequently, to the underside of the window sash 25) as well as to the window frame 17. The end 29 of the first arm 27 of the hinge 26 is slidably mounted onto a track 32 which, in turn, is mounted to the frame 17. The slidable mounting of the end 29 of the arm 27 in the track 32 enables the sash 25 to move laterally to the left as well as outward as the window is opened. As a result, a gap is provided between the sash 25 and the vertical frame member 33 which enables the glazing (not shown) of the window to be cleaned from the inside of the building.

When an operator 10, made in accordance with the present invention, is utilized, cleaning-type hinges such as the one shown at 26 is not mandatory. In contrast, the operator 10 of the present invention is equally useful with egress and butt hinges as well.

The distal end 34 of the lead arm 23 is pivotally attached to the sash 25. However, as discussed below, due to the telescopic effect of the arm 16, the placement of the distal end 34 along the sash 25 may be varied to a reasonable extent without adversely affecting the performance of the operator 10. That is, the distal end 34 of the arm 23 need not be precisely mounted onto a specific point along the sash 25; because of the telescopic effect of the operator 16, less precision is required which makes the operator 10 easier to install and the overall window assembly easier to manufacture.

Turning to FIG. 3, the telescopic operator arm assembly 16 is illustrated. The inner arm 15 is either integrally connected to the arched gear segment 14 or the arm 15 may be fabricated from a separate part and subsequently attached to the arched gear segment 14. The aperture shown at 35 accommodates the shaft shown at 22 in FIGS. 1 and 2 and provides a pivot point for the arm 15 and arched gear segment 14. The distal end 36 of the arm 15 includes an upwardly protruding tab or finger 37. This tab 37, in combination with the corresponding tab or protruding member 38 disposed within the plastic insert 42, serves as a stop for the middle arm 24 and prevents the middle arm 24 from sliding off of the distal end 36 of the inner arm 35. Similarly, the distal end 52 of the lead arm 23 includes a tab or finger 52 which engages the tab or protruding member 53 disposed in the bearing insert 39 which prevents the lead arm 23 from sliding off the middle arm 24.

Turning to the plastic inserts shown at 39 and 42, these inserts are accommodated within the interior walls 43, 44 of the middle arm 24. The inserts 39, 42 provide reduced friction sliding of the middle arm 24 along the inner arm 15 and reduced frictional sliding of the lead arm 23 along the middle arm 24. To this extent, the inserts 39, 42 are preferably fabricated from a friction reducing material such as an acetal homopolymer sold under the brand name DELRIN which is sold by DuPont Co. of Wilmington, Del. Their plastics such as polypropylene may also be used, provided they are weather resistant and provide a smooth, slipper and long lasting surface. Moreover, conventional balls or rollers in suitable cages may also be used as bearing inserts. The races or slots 50, 51 of the insert 42 accommodate the bearing surfaces 68, 58 of the lead arm 23 and inner arm 15 respectively. The races or slots 56, 57 of the insert 39 accommodate the bearing surfaces 69, 59 lead arm 23 and inner arm 15 respectively.

The inserts 39, 42 may be secured within the middle arm 24 by way of the combination of the button 45 on the insert 39 and the hole 46 along the inside wall 44 of the middle arm 24 as well as the hole 47 and a corresponding button (not shown) disposed along the outside wall of the insert 42.

The lead arm 23 includes an aperture 48 for attaching the distal end 34 of the lead arm 23 to the sash 25. As noted above, the proximate end of the lead arm 23 also includes a tab 52 which engages the corresponding tab 53 disposed along the interior of the bearing insert 39.

In a preferred embodiment, the axis of the inner arm 15 defined by the aperture 35 is offset from the inner arm 15 by about 1⅜ inches. This offset facilitates the installation of the operator 10 in a standard window frame as illustrated in FIG. 4. Specifically turning to FIG. 4, the operator 10 is installed in the window frame 17 by inserting the plate 18 and arm 15 through the slot shown at 54. The above-referenced dogleg or offset between the inner arm 15 and arched gear segment 14 enables the arm 15 to be disposed underneath the sash and parallel to the frame member 17. The distal end 34 of the lead arm 23 may be attached to the sash 25 by way of a snap stud shown in 55 or other suitable fastening means.

Figure 8:
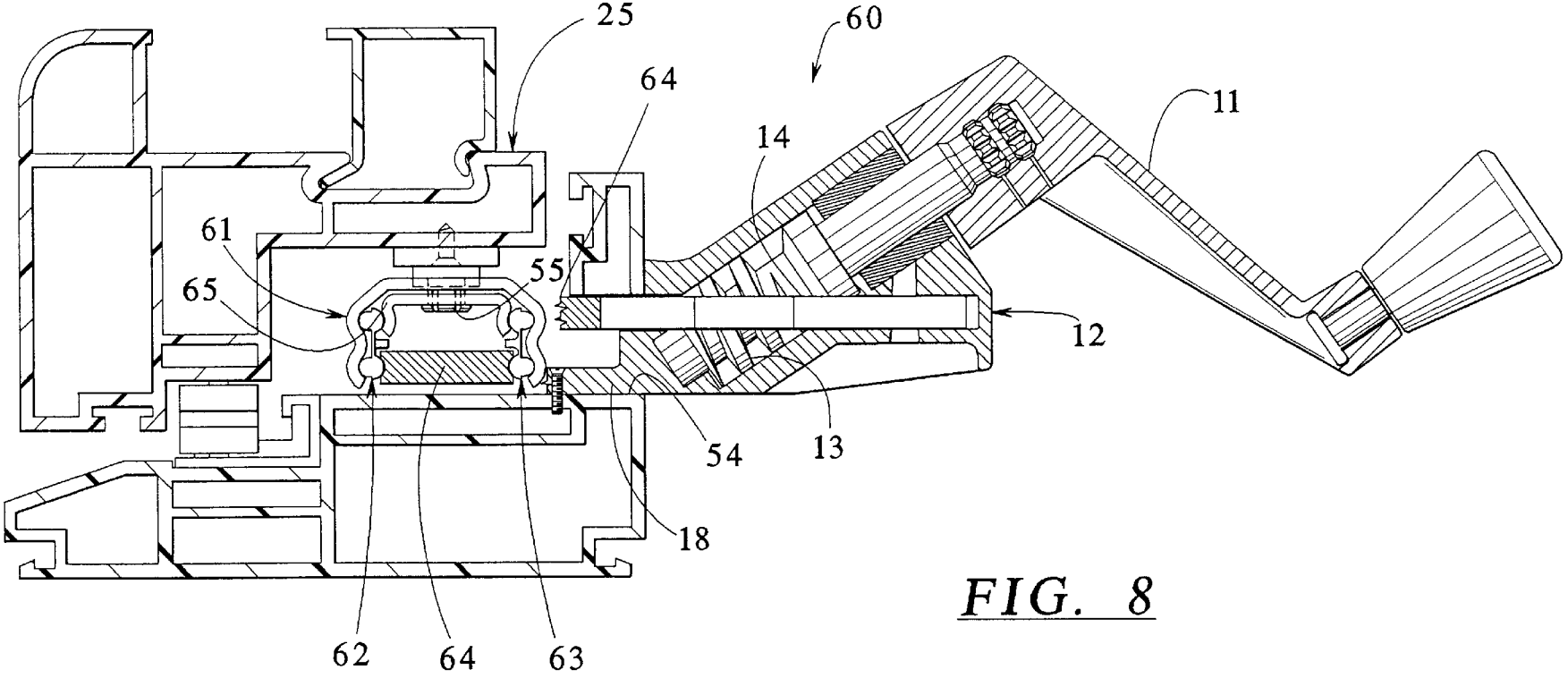
FIG. 8 is an end sectional view of an alternative embodiment of a casement window operator made in accordance with the present invention.

FIG. 8 illustrates an alternative embodiment of the casement window operator of the present invention. Specifically, the operator 60 illustrated in FIG. 8 includes a center arm 61 with two curves in each side wall for accommodating the bearing inserts 62, 63, which also feature rounded bearing edges. As a result, the inner arm 64 includes concave side walls to accommodate the curved bearing edges of the bearing inserts 62, 63 and the upper arm 65 has an inverted U-shaped configuration with curved side walls to accommodate the curved bearing surfaces of the bearing inserts 62, 63. Other than the specific configuration of the arms 64, 61 and 65 as well as the inserts 62, 63, the operator 60 is essentially the same as the operator 10 illustrated in FIGS. 1 through 7. Accordingly, like reference numerals have been used to identify the like or similar parts.

From the above description, it is apparent that the objects and advantages of the present invention have been achieved. While only certain embodiments have been set forth, alternative embodiments and various modifications will be apparent from the above description to those skilled in the art. For example, the cross sections of the inner arm 15 and lead arm 23 is a matter of design choice and will depend upon the specific design of the bearing inserts 39, 42. Further, the specific configuration of the bearing surfaces of the bearing inserts 39, 42 is also a matter of design choice. As shown in the contrasting embodiments of FIGS. 4 and 7, the cross section of the middle arm 24 may also be varied as well as the configuration of the arched gear segment 14 and worm gear 13. These and other alternatives are considered equivalents and within the spirit and scope of the present invention.

What is claimed is:

1. A window operator for use in moving a window sash between open and closed positions with respect to a window frame, the operator comprising:

a housing for accommodating a first gear segment mounted for rotation about an axis, the gear segment being connected to a handle, an arm assembly comprising a proximate end portion comprising a second gear segment and distal end portion for pivotal connection to a sash, the second gear segment being enmeshed with the first gear segment, the arm assembly rotating upon rotation of the first gear segment and extending radially with respect to the axis upon rotation of the gear segment, the arm assembly further comprising a first arm segment and a second arm segment, the first arm segment comprising an inverted U-shaped cross section that at least partially surrounds the second arm segment for telescopic movement of the second arm segment with respect to the first arm segment, the arm assembly further comprising at least one anti-friction bearing connected to the first arm segment and disposed between the first arm segment and the second arm segment, the anti-friction bearing comprising a protruding member, the second arm segment comprising a protruding member, the protruding members of the anti-friction bearing and the second arm segment engaging each other to limit movement of the first arm segment with respect to the second arm segment.

2. The operator of claim 1 wherein the distal end portion of the arm assembly is pivotally connected to the sash for pivoting movement about a fixed point on the sash.

3. The operator of claim 1 wherein the at least one anti-friction bearing is formed of a plastic material.

4. The operator of claim 1 wherein the arm assembly comprises three slidably connected extending members.

5. The operator of claim 1 for use with the sash that is mounted to the frame at least for pivoting movement about a pivot axis of the sash, wherein the gear segment is mounted for rotation in a first plane normal to the pivot axis of the sash, and the arm assembly lies in a second plane substantially parallel to the first plane of rotation of the gear segment.

6. The operator of claim 1 wherein the first gear segment comprises a worm gear mounted in meshing engagement with the second gear segment.

7. The operator of claim 2 wherein the anti-friction bearings are disposed between the first and second members.

8. A window operator comprising a housing, a worm gear mounted for rotation in the housing, an arm assembly comprising a proximal end portion adapted to be mounted in the housing for rotation about a fixed axis upon rotation of the worm gear and a distal end portion adapted to be pivotally connected to a window sash, the arm assembly further comprising an inner arm and a second arm telescopically mounted to the inner arm, the two arms sliding longitudinally with respect to each other as the worm gear is rotated, the second arm comprising anti-friction bearings extending along a length of the second arm for facilitating longitudinal movement of the first arm with respect to the second arm, the arm assembly further comprising a third arm mounted for telescopic movement with respect to the second and inner arms, the inner, second and third arms each comprising peripheral surfaces and races formed in said peripheral surfaces, the anti-friction bearings of the second arm disposed between the races to facilitate sliding motion between the arms.

9. The operator of claim 8 wherein the anti-friction bearings are continuous strips of a friction reducing material.

10. The operator of claim 8 wherein the anti-friction bearings include extension limiting protruding members which engage the inner and third arms to limit longitudinal movement of the inner, second and third arms with respect to each other.

11. The operator of claim 8 wherein the anti-friction bearings are fixed to the second arm.

12. A telescopic arm assembly for a window operator comprising:

a first arm comprising an opposed pair of bearing surfaces extending parallel to each other, a second arm comprising a longitudinal channel and receiving the first arm for telescopic movement of the first arm in the channel, a pair of bearings disposed on opposing sides of the longitudinal channel of the second arm, each bearing comprising a first longitudinally extending race for sliding engagement with one of the bearing surfaces of the first arm, the second arm further comprising longitudinal recesses supporting each bearing, each bearing comprising a projection that cooperates with the first arm to limit longitudinal movement of the first arm with respect to the second arm.

13. The telescopic arm assembly of claim 12 further comprising a third arm with an opposed pair of bearing surfaces and wherein each bearing further comprises a second longitudinally extending race for sliding engagement with one of the bearing surfaces of the third arm.

14. A window operator comprising a housing, a worm gear mounted for rotation in the housing, an arm assembly comprising a proximal end portion adapted to be mounted in the housing for rotation about a fixed axis upon rotation of the worm gear and a distal end portion adapted to be connected to a window sash, the arm assembly further comprising an inner arm, a second arm telescopically mounted to the inner arm and a third arm mounted for telescopic movement with respect to inner and second arms, the inner, second and third arms each comprising peripheral surfaces and races formed in said peripheral surfaces, the arm assembly further comprising bearings disposed between the races to facilitate sliding motion between the arms, the two arms sliding lengthwise with respect to each other as the worm gear is rotated.

15. The window operator of claim 14 wherein the inner, second and third arms each comprising peripheral surfaces and races formed in said peripheral surfaces, the anti-friction bearings of the second arm disposed between the races to facilitate sliding motion between the arms.

16. The operator of claim 14 wherein the bearings include extension limiting protruding members which engage the inner and third arms to limit longitudinal movement of the inner, second and third arms with respect to each other.

17. The operator of claim 14 wherein the bearings are fixed to the second arm.

* * * * *